US006111486A

United States Patent [19]

Fischer et al.

[11] Patent Number: 6,111,486

[45] Date of Patent: Aug. 29, 2000

[54] TRIP UNIT SETTINGS LOCK OUT ASSEMBLY

[75] Inventors: Kenneth M. Fischer, Finleyville; Henry Richard Beck, Coraopolis; Joseph Bell Humbert, Monaca, all of Pa.

[73] Assignee: Eaton Corporation, Cleveland, Ohio

[21] Appl. No.: 09/286,942

[22] Filed: Apr. 8, 1999

[51] Int. Cl.[7] ..... H01H 75/10; H01H 77/06; H01H 81/04; H01H 9/28

[52] U.S. Cl. ..... 335/42; 200/43.22; 335/202

[58] Field of Search ..... 335/6, 17, 34, 335/42, 45, 67, 117, 132, 156, 157, 176, 202; 200/43.01, 43.16, 43.18, 43.19, 43.22, 333

[56] References Cited

U.S. PATENT DOCUMENTS

| | | | |
|---|---|---|---|
| 3,761,776 | 9/1973 | Willard | 335/17 |
| 5,341,191 | 8/1994 | Crookston et al. . | |
| 5,362,933 | 11/1994 | Kutsche et al. | 200/401 |
| 5,367,427 | 11/1994 | Matsko et al. . | |

*Primary Examiner*—Michael L. Gellner
*Assistant Examiner*—Raymond Barrera
*Attorney, Agent, or Firm*—Martin J. Moran

[57] ABSTRACT

A circuit breaker having a trip unit includes a lock out assembly positioned adjacent the trip unit for controlling access thereto. The lock out assembly includes a base member, a cover member and a slide member received therebetween. The slide member is moveable between various positions for controlling access to settings for the various operating parameters of the circuit breaker as provided by the trip unit.

7 Claims, 5 Drawing Sheets

TRIP UNIT SETTINGS LOCK OUT ASSEMBLY

BACKGROUND OF THE INVENTION

1. Field of the Invention

This invention relates to circuit breakers having a trip unit, and more specifically, to a lock out assembly for controlling access to the trip unit.

2. Background Information

Circuit breakers, and in particular, circuit breakers of the molded case variety (see, for example, U.S. Pat. No. 5,341,191), are generally known in the art and used for protecting electrical circuitry from damage due to an overcurrent condition, such as an overload condition or a relatively high level short circuit or fault condition. Molded case circuit breakers typically include a pair of separable contacts per phase which may be operated either manually by way of a handle disposed on the outside of the case or automatically in response to an overcurrent condition. Typically, such circuit breakers include an operating mechanism, which is designed to rapidly open and close the separable contacts, and a trip unit, which senses overcurrent conditions in an automatic mode of operation. Upon sensing an overcurrent condition, the trip unit trips the operating mechanism to a trip state which moves the separable contacts to their open position.

It is also well known to employ trip units which utilize a microprocessor to detect various types of overcurrent trip conditions, such as, for example, a long delay trip, a short delay trip, an instantaneous trip, or a ground fault trip. The long delay trip function protects the load served by the protected electrical system from overloads and/or overcurrents. The short delay trip function can be used to coordinate tripping of down stream circuit breakers in a hierarchy of circuit breakers. The instantaneous trip function protects the electrical conductors to which the circuit breaker is connected from damaging overcurrent conditions, such as short circuits. As implied, the ground fault trip function protects the electrical system from faults to ground.

Each circuit breaker is designed for a specific maximum continuous current. This current rating may be set by selection of a resistor which converts the current to a voltage for use by the trip unit. This device is commonly referred to in the art as a "rating plug." In some instances, a single circuit breaker frame may be easily adapted for installations which call for a range of maximum continuous currents, up to the design limits of the frame, through use of the rating plug by which the current rating of the device can be established. Typically, the pick-up currents for the various protection functions have been selectable multiples or fractions of this current rating. Thus, instantaneous protection trips the device any time the current reaches a selected multiple of the rated current, such as for example, ten times the rated current. Pick-up for short delay protection is a lesser multiple of the rated current, while pickup current for long delay protection may be a fraction of the rated current.

The long delay and short delay trip functions require that the overcurrent condition exists for a period of time. Typically, the long delay trip function has been selected such that a trip signal is generated if the current exceeds six times the rated current for the selected long delay interval. As damage can also occur at lesser current levels for longer periods of time, an inverse time function is used for long delay protection. Thus, the smaller the current the longer the time to trip, and the larger the current, the shorter the time to trip.

With the traditional approach of having the instantaneous, short delay and long delay pick-up currents selectable as factors of the rated current, the protection functions are independent of one another, so that setting the parameters for one function does not typically affect the setting of parameters for another function. Typically, setting of the parameters for each of the protection functions is achieved by a user interfacing with the various settings on the trip unit. For example, it is known to provide adjustment and setting means that are recessed from the face of the trip unit and adjustable by an appropriate tool, such as a screwdriver. In this type of arrangement, the settings can be easily changed without proper authorization. This can cause nuisance trip situations due to the incorrect settings of the circuit breaker, or cause damage to the load.

In addition, it is typically the situation where the rating plug may also be reset, or removed altogether, due to its positioning on or adjacent the face of the trip unit, which is typically located on the outside of the circuit breaker housing. This also can result in improper protection to the electrical system and in nuisance trip situations, as well as, damage being done to the circuit breaker due to improper rating plugs or settings thereof being employed.

There is a need, therefore, for a circuit breaker having a trip unit that prevents adjustments being made to the settings for the operating parameters and/or the rating plug and settings thereof without proper authorization.

SUMMARY OF THE INVENTION

This need and others are satisfied by the invention which is directed to a circuit breaker which includes an electrically insulative housing, separable electrical contacts disposed within the housing and movable between a closed position for establishing a current path through the circuit breaker and an open position for interrupting the current path, and operating means for closing, opening and tripping open the separable electrical contacts. The circuit breaker also includes a trip unit for cooperating with the operating means in order to trip open the separable electrical contacts in response to a predetermined electrical condition. The trip unit includes an operator panel which includes means for setting the operating parameters of the trip unit, such as, for example, the long delay trip, the short delay trip, the instantaneous trip, and the ground fault trip settings. The circuit breaker of the invention also includes a lock out assembly positioned adjacent the operator panel for controlling access to the means for setting the operating parameters.

The lock out assembly includes a base member, a cover member, and a slide member received therebetween. The slide member is moveable between a first position for resisting access to the means for setting and a second position for allowing access to the means for setting. Preferably, the slide member includes at least one access aperture extending therethrough wherein the access aperture is in alignment with the means for setting when the slide member is in the second position.

The lock out assembly may also include means for securing the slide member in the first position. Advantageously, this minimizes the possibility of a user making unauthorized changes to the settings of the trip unit. In addition, the lock out assembly may also include means for limiting movement of the slide member with respect to the base member and the cover member. Advantageously, this allows for the slide member to move without being removed from the lock out assembly altogether.

The trip unit may also include means for establishing a current rating for the circuit breaker, such as a rating plug.

The slide member may also be moveable to a third position for allowing access to the means for establishing a current rating. Preferably, access to the means for establishing a current rating is resisted when the slide member is in the first position or second position.

Preferably, the slide member is formed from a transparent material to provide for visual inspection of the operator panel of the trip unit and/or the means for establishing a current rating. This allows for convenient visual inspection of the trip unit while minimizing the possibility of unauthorized changes being made to the settings or the rating plug.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
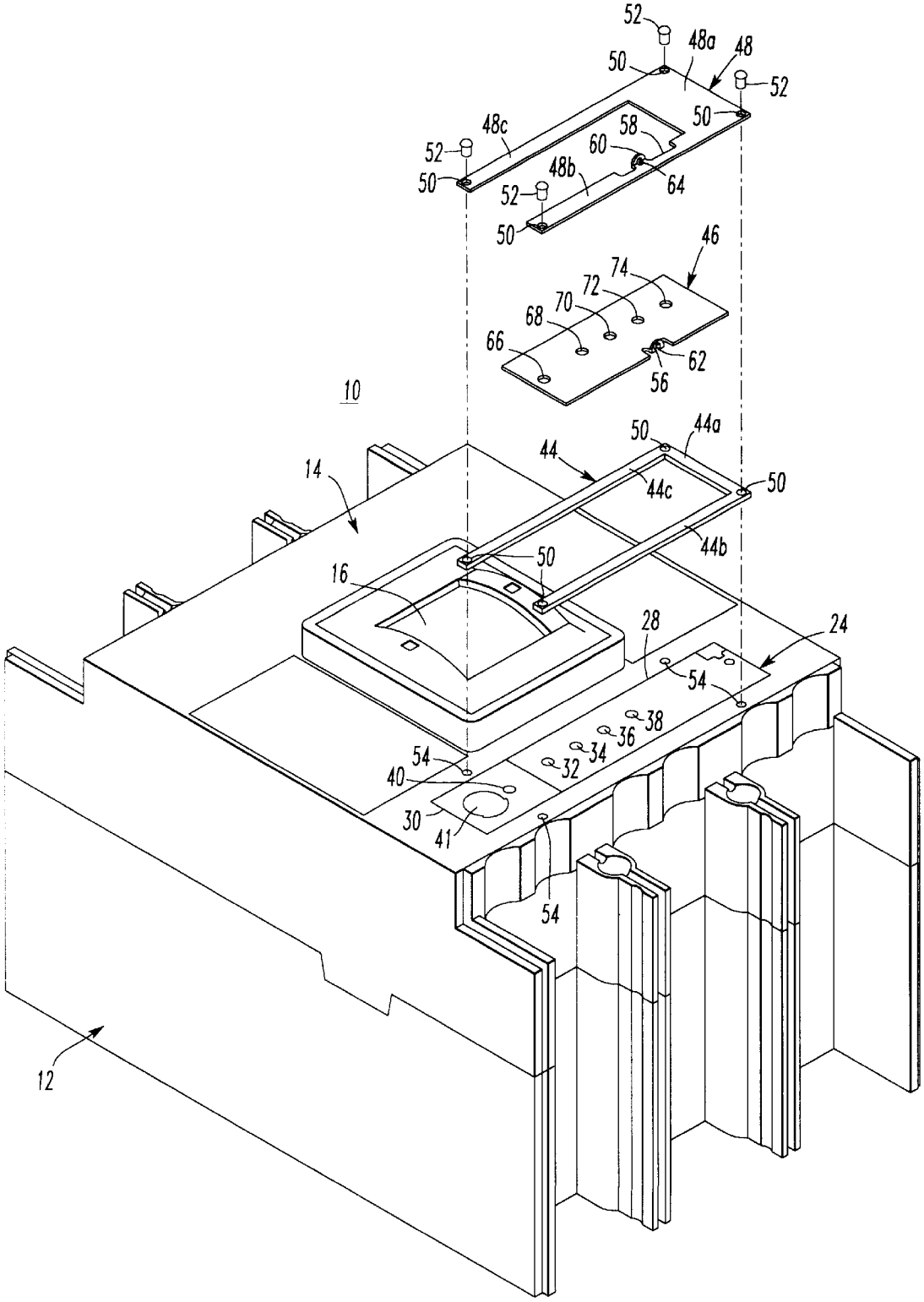
FIG. 1 is an isometric view of a circuit breaker of the invention.
Figure 2:
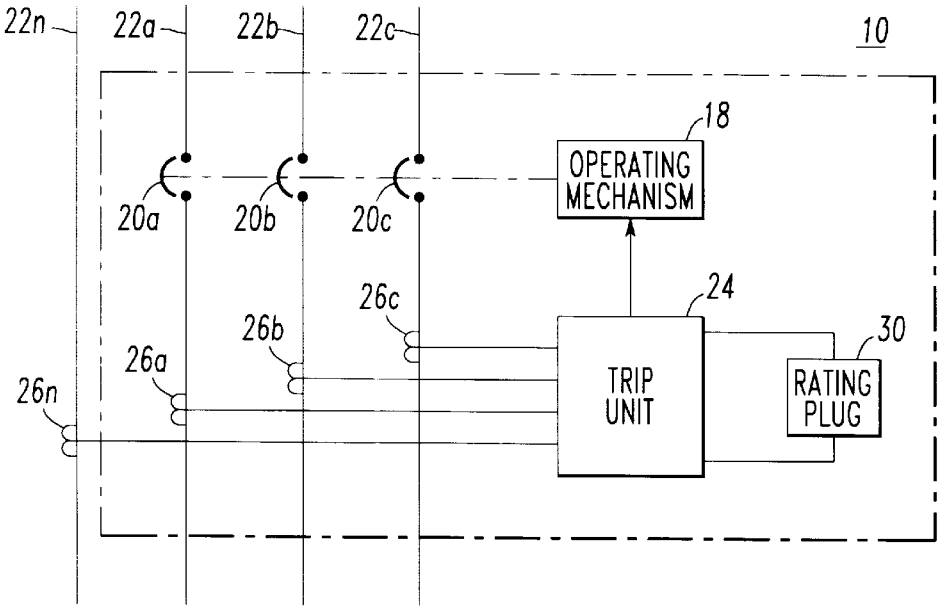
FIG. 2 is a schematic circuit diagram of the circuit breaker of the invention.

Referring to FIGS. 1 and 2, there is shown a circuit breaker 10 of the invention. The circuit breaker 10 is a molded case circuit breaker, as is generally known in the art, and includes an electrically insulative housing 12 having a front cover 14 attached thereto. The front cover 14 includes a handle opening 16 through which extends an operating handle (not shown) to manually operate an operating mechanism 18 for closing (not shown) or opening sets of separable electrical contacts 20*a*, 20*b* and 20*c*. As shown in FIG. 2, the circuit breaker 10 includes three phase conductors 22*a*, 22*b* and 22*c*, and may also include a neutral conductor 22*n*. It should be appreciated that while the present invention is illustrated and described in conjunction with a circuit breaker for a three phase electrical system, the invention is not limited thereto and is applicable to other circuit breakers for use with a single phase or polyphase electrical systems.

Still referring to FIGS. 1 and 2, the circuit breaker 10 also includes a trip unit 24 for cooperating with the operating mechanism 18 in order to trip open the sets of separable electrical contacts 20*a*, 20*b* and 20*c* in response to a predetermined electrical condition in the current path of the conductors 22*a*, 22*b* and 22*c*. Sensing mechanisms, such as current transformers 26*a*, 26*b* and 26*c*, generate signals representative of the currents flowing in the respective phase conductors 22*a*, 22*b* and 22*c*, and in the neutral conductor 22*n*, if desired. The trip unit 24 monitors the currents sensed by the current transformers 26*a*, 26*b*, 26*c* and 26*n* and generates a trip signal in response to the predetermined electrical conditions. The operating mechanism 18 responds to the trip signal from the trip unit 24 and opens the sets of separable electrical contacts 20*a*, 20*b* and 20*c* to interrupt current through the phase conductors 22*a*, 22*b* and 22*c* of the electrical system being protected by the circuit breaker 10.

The circuit breaker 10 is capable of providing several modes of protection of the types previously discussed, such as long delay, short delay, instantaneous and ground fault protection. The trip unit 24, as illustrated in FIGS. 1 and 3–5, includes an operator panel 28 having a rating plug 30. The trip unit 24 provides for short delay and ground fault protection. It will be appreciated that other modes of protection, such as long delay, could also be provided.

The operator panel 28 of the trip unit 24 includes means for setting the operating parameters of the trip unit in order to provide the various modes of protection. Specifically, an opening 32 is provided for adjusting and/or setting the short delay pick-up current along with another opening 34 for adjusting and/or setting the selected time setting associated with the short delay pick-up current. Similarly, an opening 36 is provided in the operator panel 28 to provide for adjusting and/or setting the ground fault pick-up current along with opening 38 for adjusting and/or setting the selected time setting associated therewith. The openings 32, 34 and 36, 38 allow for an adjustment tool, such as a screwdriver, to be inserted therein to adjust and/or set the various operating parameters. These characteristics and features of the trip unit 24 are generally known in the art.

An additional opening 40 is provided on the rating plug 30 of the operator panel 28 to allow for adjustment of the maximum continuous currents allowed by the rating plug 30. As is generally known, the rating plug 30 is typically removable in order to allow for further adjustment of the maximum current rating.

Referring to FIGS. 1 and 3–6, there is shown a lock out assembly, generally designated by reference numeral 42, that is positioned adjacent the trip unit 24 for controlling access to the operator panel 28 and the rating plug 30. Preferably, the lock out assembly 42 is mounted to the front cover 14 of the circuit breaker 10, as will be described in more detail herein.

The lock out assembly 42 includes a base member 44, a slide member 46 and a cover member 48. Once assembled, the slide member 46 is received between the base 44 and the cover 48 such that the slide member 46 is movable between various positions for controlling access to the trip unit 24, and specifically for controlling access to the operator panel 28 and the rating plug 30. It will be appreciated that the lock out assembly 42 may be constructed as described herein or may be constructed, for example, with the base and cover as an integral piece for receiving the slide member.

In the preferred embodiment, the base 44 is constructed having a generally U-shape and includes an end piece 44*a* having a first leg 44*b* and a second leg 44*c* extending therefrom. Similarly, the cover 48 is constructed having a generally U-shape and includes an end piece 48*a* with a first leg 48*b* and a second leg 48*c* extending therefrom. Preferably, the slide member 46 is generally rectangular for positioning between the base 44 and the cover 48, as will be described in more detail herein.

A plurality of apertures 50 may be provided in the base 44 and the cover 48 for receipt of fastening means, such as screws 52, which in turn are received in holes 54 formed in the front cover 14 of the circuit breaker 10. This allows for the lock out assembly 42 to be secured to the front cover 14. Alternatively, other means may be provided for securing the lock out assembly 42 to the front cover 14, such as, for example, adhesively securing the cover 48 to the base 44 and then adhesively securing the base 44 to the front cover 14.

Figure 6:
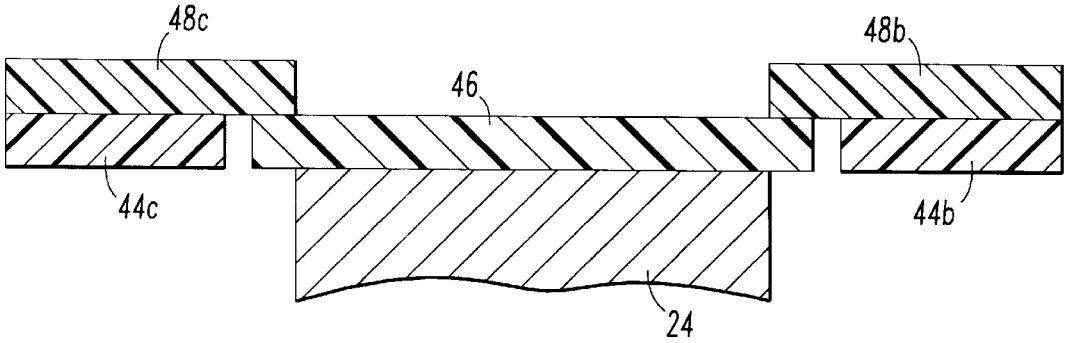
FIG. 6 is a partial sectional view taken along line 6—6 of FIG. 3.

The slide member 46 is received within the end piece 44*a*, the first leg 44*b* and the second leg 44*c* of the base 44 (see FIG. 6). The cover 48 is then placed over the slide member 46 and the base 44. It will be appreciated that the end piece 48*a*, the first leg 48*b* and the second leg 48*c* of the cover 48 all preferably have a greater width than the respective end piece 44*a*, the first leg 44*b* and the second leg 44*c* of the base 44. Advantageously, this allows for the cover 48 to retain the slide member between the base 44 and the cover 48 preventing the upward removal of the slide member 46. The greater widths of the end piece 48*a*, the first leg 48*b* and the second leg 48*c* of the cover 48 which overlay the slide member 46 are best illustrated in FIGS. 3–6.

The slide member 46 also includes a locking tab 56 extending generally upwardly therefrom. The locking tab 56 is received in a notch 58 formed in the first leg 48*b* of the cover 48 to limit sliding movement of the slide member 46. This prevents the slide member 46 from being removed from the lock out assembly 42 via the open ends of the base 44 and the cover 48, where the open ends are generally opposite the end piece 44*a* and the end piece 48*a*.

Also formed on the first leg 48*b* of the cover 48 adjacent the notch 58 is an additional locking tab 60. The locking tab 60 is formed for cooperation with the locking tab 56 of the slide member 46 in order to maintain or lock the slide member 46 in a desired position with respect to the cover 48, as will be explained in more detail herein. The locking tab 56 includes an aperture 62 extending therethrough and, similarly, locking tab 60 includes an aperture 64 extending therethrough. The apertures 62, 64 are provided for cooperation with a means for securing or locking the slide member 46 in a desired position, as will be described.

The slide member 46 includes a plurality of access apertures 66, 68, 70, 72 and 74 extending therethrough. These apertures provide a means for adjusting the operating parameters of the trip unit 24 once the lock out assembly 42 is installed on the front cover 14 of the circuit breaker 10, as will be described in more detail herein.

Figure 3:
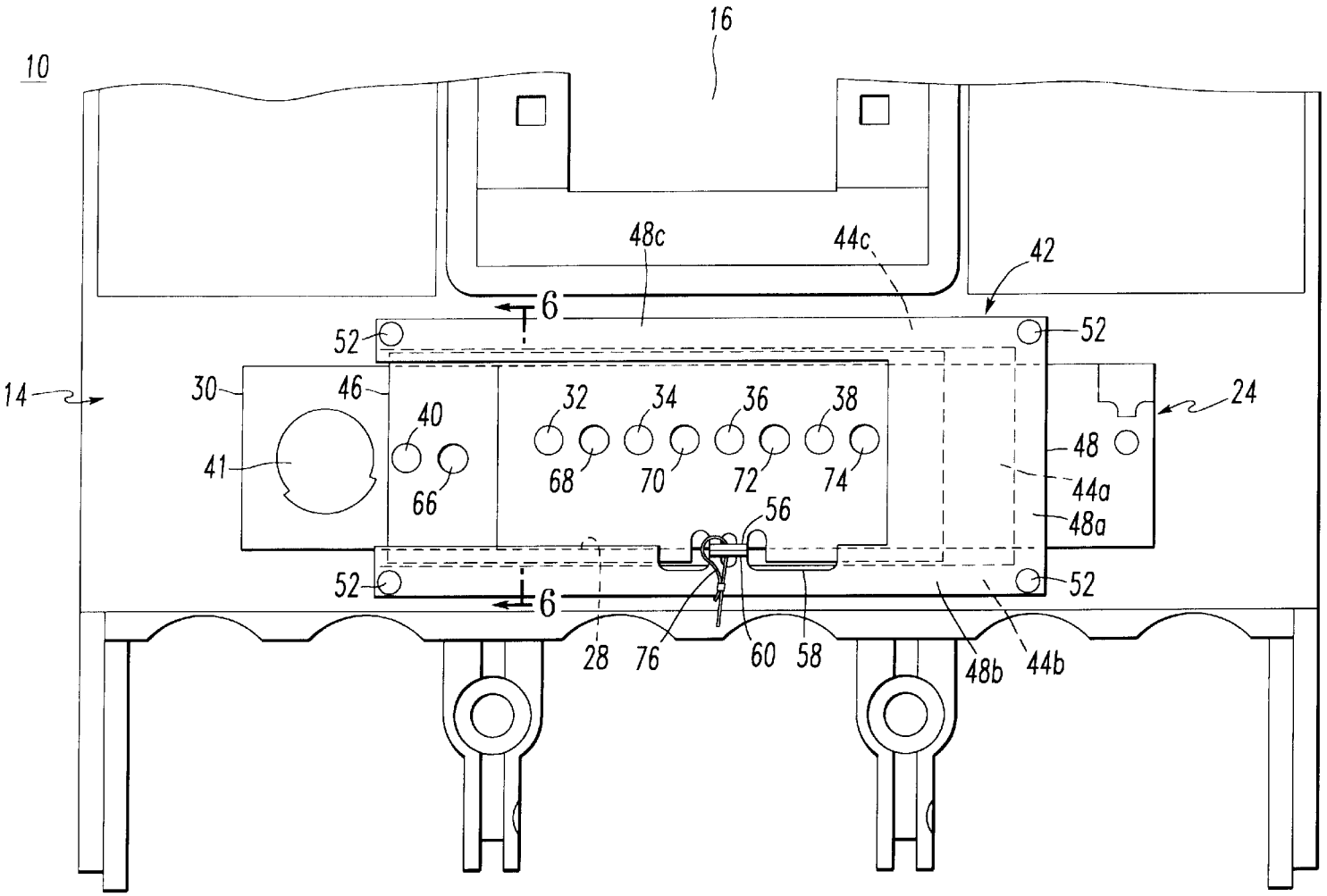
FIG. 3 is a fragmentary plan view of a front cover of the circuit breaker showing a lock out assembly in a first position.

Referring to FIG. 3, the lock out assembly 42 is shown as assembled and in a first position for resisting access to the openings 32, 34, 36, 38 and 40, which as previously described allow for the adjustment and/or setting of the operating parameters for the short delay, ground fault and rating plug. Access to the various settings is prevented by the access apertures 66, 68, 70, 72 and 74 of the slide member 46 being out of alignment with the respective openings 40, 32, 34, 36 and 38. To insure that the slide member 46 remains in the first position to prevent unauthorized adjustments being made to the settings of the trip unit 24, a tamper-proof wire clip 76 is installed through the locking tabs 56 and 60. It will be appreciated that when the slide member 46 is in the first position, as shown in FIG. 3, the apertures 62 and 64 of the respective locking tabs 56 and 60 are in alignment for receipt of the wire clip 76. Of course, it will be appreciated that other means for locking or securing the slide member 46 in the first position, such as, for example, a padlock, may be utilized in conjunction with the invention.

Figure 4:
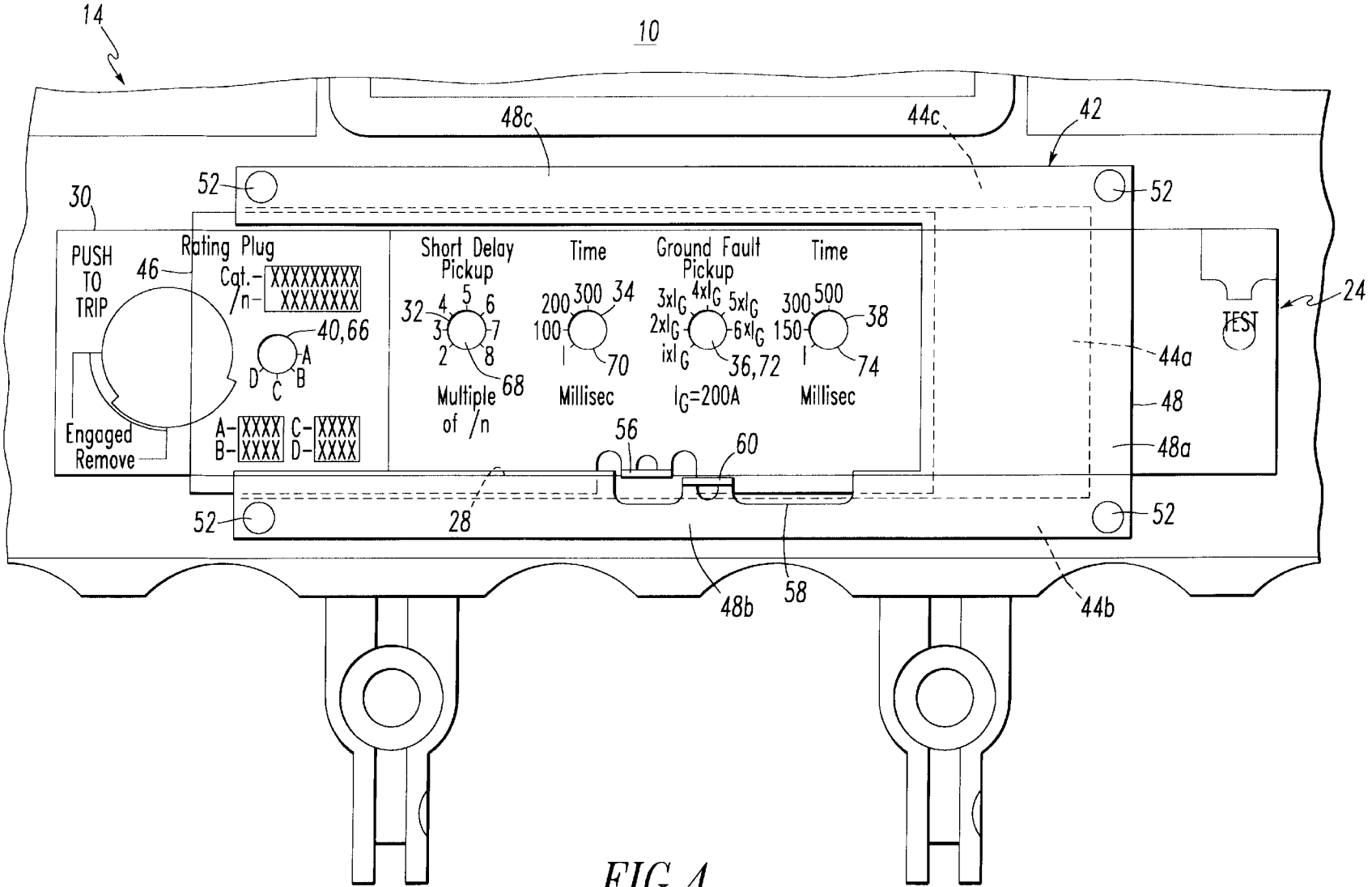
FIG. 4 is a view, similar to FIG. 3, showing the lock out assembly in a second position.

Referring to FIG. 4, the slide member 46 is shown in a second position where the access apertures 66, 68, 70, 72 and 74 are in alignment with the respective openings 40, 32, 34, 36 and 38 to allow for adjustment of the rating plug current rating, the short delay pick-up current and time setting, and the ground fault pick-up current and time setting. As can be appreciated, an adjustment tool, such as a screwdriver, may be easily inserted through any of the aligned apertures and openings to adjust the setting accordingly.

Figure 5:
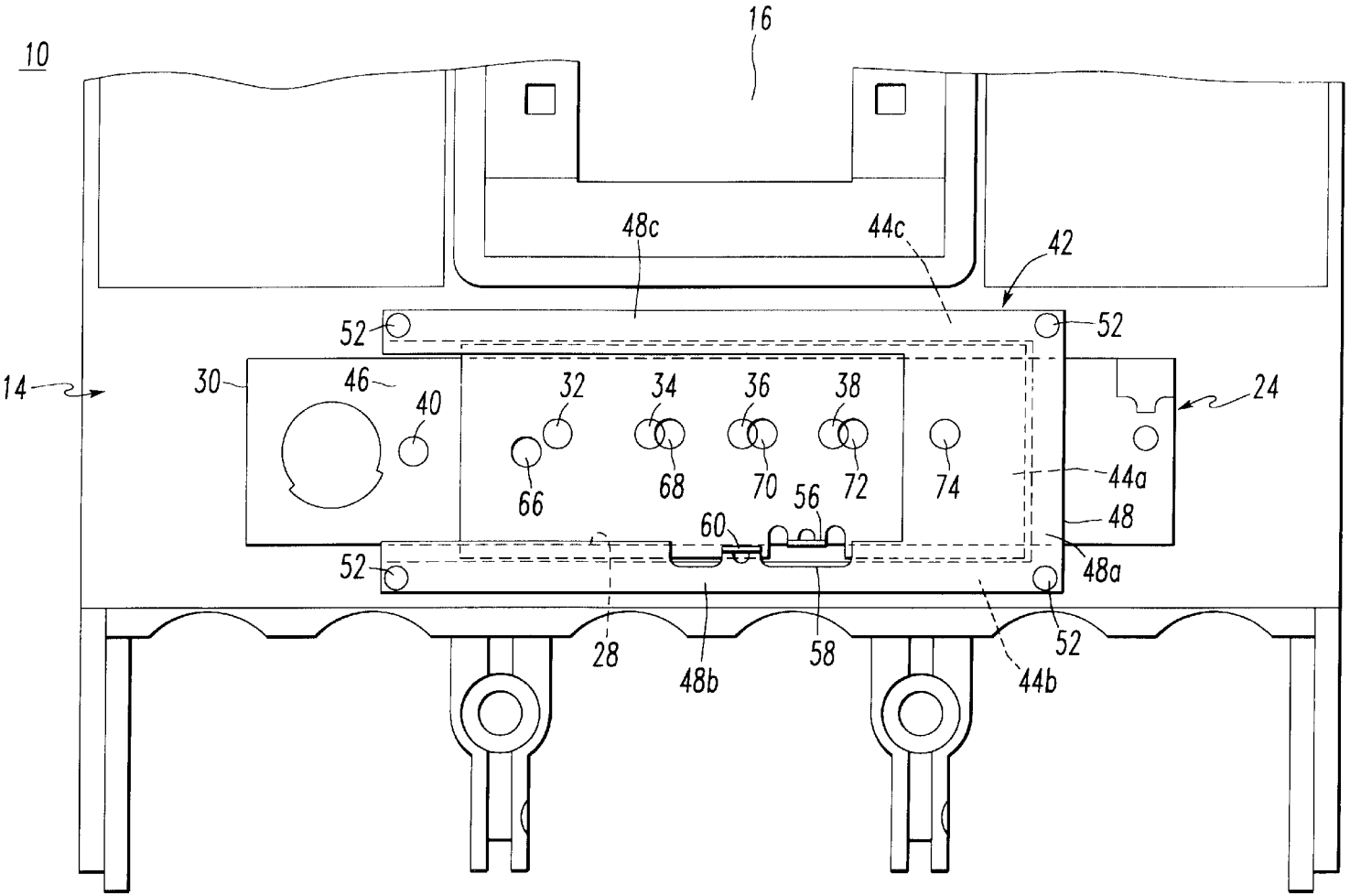
FIG. 5 is a view, similar to FIGS. 3 and 4, showing the lock out assembly in a third position.

Referring to FIG. 5, the slide member 46 is shown in a third position to allow for access to the rating plug 30. This allows for the rating plug 30 to be removed and replaced with an additional rating plug having a different range of current ratings, if desired. In addition, access may be provided to the opening 40 for adjusting the current rating of the rating plug 30 if the rating plug 30 is the adjustable type (some rating plugs are not adjustable and must be completely replaced to adjust the current rating, as is known in the art).

It will be appreciated that the slide member 46 is configured and positioned for movement to provide maximum access control to the trip unit 24. Specifically, it will be appreciated that when the slide member 46 is in the first position, as shown in FIG. 3, access is restricted to the rating plug 30, and the openings 32, 34, 36, 38 and 40 for adjusting the various operating parameters. When the slide member 46 is in the second position, as shown in FIG. 4, the access apertures 66, 68, 70, 72 and 74 are in alignment with the openings 40, 32, 34, 36 and 38 to allow for adjustment of the various operating parameters. But, when the slide member 46 is in the second position, access to the rating plug 30 is restricted to prevent removal of the rating plug 30, although the adjustment setting can be changed. Advantageously, this allows for the various settings of the operating parameters to be adjusted in accordance with the particular rating plug 30 that is presently installed in the trip unit 24. In addition, when the slide member 46 is in the third position, as shown in FIG. 5, the rating plug 30 (and possibly the opening 40 for adjusting the current rating thereof) is accessible, while the openings 32, 34, 36 and 38 for adjusting and/or setting the other operating parameters are not accessible. Therefore, it will be appreciated that the specific arrangement provided by the lock out assembly 42 provides maximum access control to the trip unit 24.

It will be appreciated that the trip unit 24 includes a manual trip actuator or "push to trip" button 41 (for manually tripping open the sets of separable electrical contacts 20*a*, 20*b* and 20*c*) that is at least partially accessible in all positions of slide member 46 to allow access to the button 41. Of course, the slide member 46 could be configured to cover the button 41 if desired.

The base 44, slide member 46 and cover 48 of the lock out assembly 42 are preferably constructed of a rigid, or semi-rigid, durable material, such as, for example, LEXAN resin sheet material. In addition, it is preferable that at least the slide member 46 be formed of a transparent material to allow for visual inspection of the trip unit, and particularly for visual inspection of the settings on the operator panel 28 and the rating plug 30. Advantageously, this allows for a user to provide a quick visual inspection of the settings of the trip unit 24 and the indicia printed on the operator panel 28 (indicia is shown, for example, in FIG. 4 only for simplicity, although it will be appreciated that the indicia would be the same or similar for the trip unit in the other figures as well) and rating plug 30 without the need for removing the wire clip 76 when the slide member 46 is in the first position to restrict access.

It will be appreciated that the circuit breaker 10 by incorporating the unique lock out assembly 42, as described herein, provides an effective means for restricting access to the operator panel and the rating plug of the trip unit. Advantageously, the lock out assembly 42 prevents unauthorized adjustments being made to the various operating parameters of the trip unit, including the removal of the rating plug and the adjustment of the rating plug setting.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A circuit breaker comprising:

an electrically insulative housing;

separable electrical contacts disposed within said housing and moveable between a closed position for establishing a current path through the circuit breaker and an open position for interrupting the current path;

operating means for closing, opening and tripping open said separable electrical contacts;

a trip unit for cooperating with said operating means in order to trip open said separable electrical contacts in response to a predetermined electrical condition in said current path;

said trip unit having an operator panel, said operator panel including means for setting operating parameters of said trip unit;

a lock out assembly position adjacent said operator panel for controlling access to said means for setting, said lock out assembly including a slide member moveable between a first position for resisting access to said means for setting and a second position for allowing access to said means for setting; and said slide member including an access aperture extending therethrough, said access aperture being in alignment with said means for setting when said slide member is in second position.

2. The circuit breaker of claim 1 wherein:

said lock out assembly includes a base member and a cover member structured for receipt of said slide member therebetween, said base member and said cover member secured by fastening means to said housing.

3. The circuit breaker of claim 2 wherein:

said lock out assembly includes means for securing said slide member in said first position.

4. The circuit breaker of claim 2 wherein:

said lock out assembly includes means for limiting movement of said slide member with respect to said base member and said cover member.

5. A circuit breaker comprising:

an electrically insulative housing;

separable electrical contacts disposed within said hosing and moveable between a closed position for establishing a current path through the circuit breaker and an open position for interrupting the current path;

operating means for closing, opening and tripping open said separable electrical contacts;

a trip unit for cooperating with said operating means in order to trip open said separable electrical contacts in response to a predetermined electrical condition in said current path;

said trip unit having an operator panel, said operator panel including means for setting operating panel including means for setting operating parameters of said trip unit; and a lock out assembly positioned adjacent said operator panel for controlling access to said means for setting, said lock out assembly including a slide member moveable between a first position for resisting access to said means for setting and a second position for allowing access to said means for setting;

said operator panel further including means for establishing a current rate for the circuit breaker; and said slide member being moveable to a third position for allowing access to said means for establishing a current rating, access to said means for establishing a current rating being resisted when said slide member is in said first position or said second position.

6. The circuit breaker of claim 5 wherein:

said slide member is formed from a transparent material to provide for visual inspection of said means for establishing a current rating.

7. The circuit breaker of claim 6 wherein:

said means for establishing a current rating includes a manual trip actuator that is accessible in all positions of said slide member.

* * * * *